US010532474B2

(12) United States Patent
Julemont et al.

(10) Patent No.: US 10,532,474 B2
(45) Date of Patent: Jan. 14, 2020

(54) BEARD TRIMMER WITH ONE OR MORE ROTARY HEADS SURROUNDED BY COMBS HAVING A PARTICULAR SHAPE AND PROVIDED WITH A COMB PROTECTION POSITION

(71) Applicant: BaByliss Faco sprl, Wandre (BE)

(72) Inventors: Pierre Julemont, Soumagne (BE); Olivier Smal, Magnee (BE)

(73) Assignee: BaByliss Faco sprl, Wandre (BE)

( * ) Notice: Subject to any disclaimer, the term of this patent is extended or adjusted under 35 U.S.C. 154(b) by 0 days.

(21) Appl. No.: 15/579,683

(22) PCT Filed: Apr. 22, 2016

(86) PCT No.: PCT/EP2016/059027
§ 371 (c)(1),
(2) Date: Dec. 5, 2017

(87) PCT Pub. No.: WO2016/198199
PCT Pub. Date: Dec. 15, 2016

(65) Prior Publication Data

US 2018/0161996 A1 Jun. 14, 2018

(30) Foreign Application Priority Data

Jun. 8, 2015 (EP) ..... 15170953

(51) Int. Cl.
*B26B 19/14* (2006.01)
*B26B 19/38* (2006.01)
(Continued)

(52) U.S. Cl.
CPC ..... *B26B 19/14* (2013.01); *B26B 19/20* (2013.01); *B26B 19/3846* (2013.01);
(Continued)

(58) Field of Classification Search
CPC ..... B26B 19/14; B26B 19/20; B26B 19/205; B26B 19/3806; B26B 19/3813; B26B 19/382; B26B 19/3853
(Continued)

(56) References Cited

U.S. PATENT DOCUMENTS 1,988,199 A * 1/1935 Greco et al. ..... B26B 19/20 30/202
2,246,459 A * 6/1941 Bahr ..... B26B 19/14 30/233
(Continued)

FOREIGN PATENT DOCUMENTS

CN 102416631 A 4/2012
DE 2747896 A1 5/1979
(Continued)

OTHER PUBLICATIONS

Sep. 1, 2016, International Search Report of the International Searching Authority from the European Patent Office in PCT/EP2016/059027, which is the international application to this U.S. application.
(Continued)

*Primary Examiner* — Jason Daniel Prone
(74) *Attorney, Agent, or Firm* — Kolitch Romano LLP

(57) ABSTRACT

A beard trimmer may include a handle and a cover, as well as a cutting system with one or more vertical axis rotary cutting heads. The rotary cutting heads may have a moving blade and a fixed blade, each head being surrounded by a crown-shaped comb. The comb may be adjustable in height in order to adjust, in use, the distance between the blades and the skin, and thereby to adapt the cutting of the beard to the desired length. The cover is movably mounted between a closed position and an open position on the handle, such that the cover can be moved from an open position to a protec-
(Continued)

tion position where it is flush with the comb tines in order to store the device.

6 Claims, 6 Drawing Sheets

(51) Int. Cl.
*B26B 19/20* (2006.01)
*B26B 19/18* (2006.01)

(52) U.S. Cl.
CPC ..... *B26B 19/3853* (2013.01); *B26B 19/18* (2013.01); *B26B 19/3886* (2013.01)

(58) Field of Classification Search
USPC ..... 30/34.05, 43.4–43.6, 233, 233.5; D28/50
See application file for complete search history.

(56) References Cited

U.S. PATENT DOCUMENTS 2,265,305 A * 12/1941 Nyhagen ..... B26B 19/06 30/43.8
2,373,370 A 4/1945 Bahr
2,624,113 A 4/1953 Adelmo
2,659,139 A * 11/1953 Davison ..... B26B 19/14 30/34.05
2,809,425 A * 10/1957 Tettis ..... B26B 19/20 30/233.5
2,826,812 A * 3/1958 Haislip ..... B26B 19/20 30/233.5
2,838,835 A 6/1958 Jepson
2,941,293 A * 6/1960 Mazzoni ..... B26B 19/20 30/201
3,287,805 A * 11/1966 Du Charnne ..... B26B 19/20 30/202
3,392,444 A * 7/1968 Olson ..... B26B 19/3813 30/233.5
3,538,604 A * 11/1970 Walter et al. ..... B26B 19/382 30/34.05
3,793,724 A * 2/1974 Messinger ..... B26B 19/38 30/41
3,990,461 A * 11/1976 Katz ..... A45D 24/36 132/313
4,003,390 A * 1/1977 Solie ..... A45D 24/36 132/213
4,310,968 A * 1/1982 Buik ..... B26B 19/42 30/34.2
4,346,721 A * 8/1982 Molaro ..... A46B 15/0055 132/313
4,532,707 A 8/1985 Allen
4,688,329 A 8/1987 Oord
4,845,852 A * 7/1989 Sukow ..... B26B 19/20 30/201
4,888,870 A 12/1989 Fujikawa et al.
4,949,460 A * 8/1990 Sterk ..... B26B 19/20 30/200
5,007,168 A 4/1991 Messinger et al.
5,259,115 A * 11/1993 Bluder ..... B26B 19/20 30/201
5,327,648 A * 7/1994 Ullmann ..... B26B 19/20 30/200
D363,809 S 10/1995 Bone
5,884,402 A * 3/1999 Talavera ..... B26B 19/00 30/124
5,979,060 A * 11/1999 Holzbauer ..... B26B 19/20 30/200
6,076,263 A 6/2000 Andis et al.
6,226,879 B1 5/2001 Baird
6,279,234 B1 * 8/2001 Chaouachi ..... B26B 19/20 30/200
D449,708 S 10/2001 Ullmann
6,516,518 B1 * 2/2003 Garraway ..... B26B 21/4018 30/34.2
D486,267 S 2/2004 Goetschi
6,739,053 B2 5/2004 McCambridge et al.
6,874,514 B1 4/2005 Hoser et al.
6,968,623 B2 * 11/2005 Braun ..... B26B 19/20 30/201
6,978,547 B2 12/2005 Degregorio, Jr.
D521,683 S 5/2006 Pepall
7,040,021 B2 * 5/2006 Talavera ..... B26B 19/16 30/30
7,076,878 B2 7/2006 Degregorio, Jr.
7,107,692 B2 9/2006 Kappes et al.
7,114,257 B1 * 10/2006 Ortega ..... A61C 17/32 30/43.92
7,143,517 B2 12/2006 Kappes et al.
7,150,285 B2 12/2006 Saito et al.
7,243,428 B2 * 7/2007 Okaniwa ..... A45D 24/36 30/31
7,261,110 B2 8/2007 Kappes et al.
7,562,665 B2 7/2009 Saito
7,625,451 B2 12/2009 Chasen et al.
7,733,058 B2 6/2010 Takaoka et al.
7,856,720 B2 * 12/2010 Okaniwa ..... B26B 1/08 30/30
7,992,307 B2 * 8/2011 Smal ..... B26B 19/20 30/202
8,177,918 B2 5/2012 Schmitt
8,313,693 B2 11/2012 Winsell
8,484,853 B1 7/2013 Laube
8,505,205 B2 8/2013 Wevers et al.
8,601,695 B2 * 12/2013 Hamburg ..... B26B 19/14 30/34.2
D698,084 S 1/2014 Yoon
8,883,075 B2 11/2014 Henry et al.
9,216,516 B2 * 12/2015 Rees ..... B26B 21/40
9,833,914 B2 * 12/2017 Sobagaki ..... B26B 19/20
10,040,208 B2 * 8/2018 Darwinkel ..... B26B 19/20
10,131,060 B2 * 11/2018 Talavera ..... B26B 19/22
2002/0078984 A1 6/2002 Hoser et al.
2002/0092173 A1 * 7/2002 Zuidervaart ..... B26B 19/14 30/34.2
2004/0237313 A1 12/2004 Tanaka
2006/0162516 A1 7/2006 Andis et al.
2006/0230619 A1 10/2006 Williams et al.
2007/0227011 A1 * 10/2007 Caric ..... B26B 19/20 30/123
2009/0159469 A1 6/2009 Russell
2009/0188117 A1 * 7/2009 Putzer ..... B26B 19/20 30/201
2009/0277012 A1 11/2009 Mikula et al.
2009/0277024 A1 11/2009 Sinnema et al.
2010/0083508 A1 * 4/2010 Cheng ..... B26B 19/06 30/201
2010/0146791 A1 6/2010 Oh
2011/0225834 A1 9/2011 Cirilli
2013/0042487 A1 2/2013 Julemont
2015/0224656 A1 8/2015 Johnson et al.
2016/0158947 A1 6/2016 Pragt et al.
2016/0235181 A1 8/2016 Louwsma et al.
2017/0295753 A1 10/2017 Cathaud
2017/0305020 A1 10/2017 Darwinkel et al.
2017/0361477 A1 12/2017 Smal et al.
2018/0161996 A1 6/2018 Julemont et al.
2018/0207818 A1 * 7/2018 Wang ..... B26B 19/3813
2018/0222066 A1 * 8/2018 Julemont ..... B26B 19/14
2018/0222068 A1 8/2018 Halmut

FOREIGN PATENT DOCUMENTS

DE 102009041765 A1 3/2011
EP 0599401 A1 6/1994
EP 1475199 A2 11/2004
EP 1775080 A1 4/2007
EP 2481535 A1 8/2012
EP 2581180 A1 4/2013
EP 2766153 A1 8/2014
FR 2475452 A1 8/1981
GB 2069398 A 8/1981
JP 57-166570 U1 10/1982

(56) References Cited

FOREIGN PATENT DOCUMENTS

| | | | |
|---|---|---|---|
| JP | H01-212588 | A | 8/1989 |
| JP | 2008-18209 | A | 1/2008 |
| WO | 2006/018745 | A1 | 2/2006 |
| WO | 2015/043354 | A1 | 4/2015 |
| WO | 2015/055043 | A1 | 4/2015 |
| WO | 2015/123412 | A1 | 8/2015 |

OTHER PUBLICATIONS

Sep. 1, 2016, Written Opinion of the International Searching Authority from the European Patent Office in PCT/EP2016/059027, which is the international application to this U.S. application.

Mar. 8, 2016, International Search Report and Written Opinion of the International Searching Authority from European Patent Office in PCT/EP2015/079635, which is a related application of Applicant BaByLiss Faco Sprl.

Jul. 21, 2016, International Search Report and Written Opinion of the International Searching Authority from the European Patent Office in PCT/EP2016/059029, which is a related application of Applicant BaByLiss Faco Sprl.

Sep. 1, 2016, International Search Report and Written Opinion of the International Searching Authority from the European Patent Office in PCT/EP2016/062053, which is a related application of Applicant BaByLiss Faco Sprl.

Jul. 17, 2018, Non-Final Office Action from the United States Patent Office in U.S. Appl. No. 15/535,407, which is a co-pending application of Applicant BabyLiss Faco Sprl.

Feb. 26, 2019, Final Office Action from the United States Patent Office in U.S. Appl. No. 15/535,407, which is a co-pending application of Applicant BabyLiss Faco Sprl.

May 31, 2019, Advisory Action from the United States Patent Office in U.S. Appl. No. 15/535,407, which is a co-pending application of Applicant BabyLiss Faco Sprl.

Jun. 19, 2019, Non-Final Office Action from the United States Patent Office, in U.S. Appl. No. 15/579,931, which is a co-pending application of Applicant BaByliss Faco Sprl.

Aug. 7, 2019, Non-Final Office Action from the United States Patent Office in U.S. Appl. No. 15/535,407, which is a co-pending application of Applicant BabyLiss Faco Sprl.

Sep. 5, 2019, Non-final Office Action from the United States Patent Office, in U.S. Appl. No. 15/579,379, which is a co-pending application of Applicant BabyLiss Faco Sprl.

May 8, 2019, Non-final Office Action from the United States Patent Office, in U.S. Appl. No. 15/776,328, which is a co-pending application of Applicant BabyLiss Faco Sprl.

Sep. 9, 2019, Final Office Action from the United States Patent Office, in U.S. Appl. No. 15/776,328, which is a co-pending application of Applicant BabyLiss Faco Sprl.

Feb. 14, 2017, International Search Report and Written Opinion of the International Searching Authority in PCT/EP2016/076733, which is a co-pending International application of Applicant BabyLiss Faco Sprl.

* cited by examiner

BEARD TRIMMER WITH ONE OR MORE ROTARY HEADS SURROUNDED BY COMBS HAVING A PARTICULAR SHAPE AND PROVIDED WITH A COMB PROTECTION POSITION

CROSS-REFERENCE TO RELATED APPLICATIONS

This application is a national phase application of PCT/EP2016/059027, filed Apr. 22, 2016, which claims priority to European Patent Application No. 15170953.2, filed Jun. 8, 2015, each of which is hereby incorporated by reference.

FIELD OF THE INVENTION

The present invention relates to a beard trimmer comprising one or several rotary cutting heads with a vertical axis. The cutting mechanism of these rotary heads is equipped with a moving blade and a fixed blade. Each cutting head is surrounded by crown-shaped combs, the height of which is adjustable and the teeth of which have a particular geometry. In use, adjusting the height of the combs makes it possible to adjust the distance between the cutting mechanism and the skin, and thus to adjust the cutting length of the beard.

The teeth of the comb may have a length of up to 20 mm and become thinner at the end, which may cause them to break during careless manipulation. To avoid this problem, the trimmer according to the invention comprises a removably mounted cover that makes it possible to reach a protection position for the combs, where the cover is practically brought flush with the teeth of the comb in order to store the device.

BACKGROUND OF THE INVENTION

The beard trimmers of the state of the art have linear moving and fixed blades, the operation of which is based on a to-and-fro movement of the moving blade relative to the fixed blade. This type of trimmer is generally equipped with a comb that allows it to adjust the cutting length of the beard. Such beard trimmers are for example disclosed in US D 698,084, U.S. Pat. No. 6,978,547, US D 486,267, EP 2 766 153 A1, US D 363,809, US 2013/0042487, U.S. Pat. No. 7,076,878, US D 521,683, etc.

Of course, razors with multiple rotary heads exist that make it possible to achieve a very close shave, but they cannot be used to trim a beard. Razors do not have combs to adjust the distance between the cutting mechanism and the skin. To the best of our knowledge, no beard trimmer with rotary heads having a vertical axis exists in the state of the art.

The trimmers of the state of the art have a straight cutting line at the intersection of the moving teeth and fixed teeth. They have the drawback of trimming the hairs differently depending on the trimming direction, since the beard hairs are most often inclined in a direction, given that they almost never grow perpendicular to the skin. The result of trimming with these trimmers is thus very different depending on the movement direction over the beard to be trimmed.

Trimmers with cutting heads having a vertical axis comprising a protection position for the combs are not known in the state of the art.

SUMMARY OF THE INVENTION

The present invention aims to provide a beard trimmer with one or several rotary heads surrounded by combs with an adjustable length making it possible to adjust the cutting height of the beard. The trimmer comprises a cover that is movably mounted with a mechanism that makes it possible to reach a protection position for the combs in which the cover is brought, by translation, approximately flush with the teeth of the comb in order to store the device.

The present invention also discloses a trimmer with combs comprising teeth with a particular geometry favoring the penetration of the hairs in the cutting system.

The present invention discloses a beard trimmer comprising a handle and a cover, as well as a cutting system with one or several vertical axis rotary cutting heads, said rotary cutting heads comprising a moving blade and a fixed blade, each head being surrounded by a crown-shaped comb, said comb being height adjustable and allowing to adjust, in use, the distance between said blades and the skin, and thereby to adapt the cutting of the beard hairs to the desired length, characterized in that said cover is movably mounted between a closed position and an open position on said handle such that the cover can be moved from an open position into a protection position where it is flush with the teeth of the comb in order to store the device.

The preferred embodiments of the invention comprise at least one, or any appropriate combination, of the following features:

- the protection position for the combs is reached by actuating a means for moving the cover away from the handle;
- the cover is translated along the direction of a shaft to reach the protection position for the combs;
- the means for moving the cover away releases the latter from its anchoring so as to cause the translational movement by a spring 11 located around the shaft to reach the protection position for the combs;
- the movement of the cover away from the handle is motorized;
- said trimmer comprises two or three rotary heads;
- the ratio between the spacing of the teeth L1 of the comb and their thickness R1–R2, that is to say the ratio L1/R1–R2, is situated between 1 and 2, preferably between 1 and 1.8, and particularly preferably between 1.1 and 1.6 to ensure adequate penetration of the hairs in the fixed blade of the cutting system;
- the ratio between the height H of the teeth and the surface area of their section at the base of the comb is situated between 2 and 4, preferably between 2.3 and 3.5, and particularly preferably between 2.5 and 3 $mm^{-1}$;
- the axial angle "A" varies between 7 and 11°, preferably between 8 and 10°, and particularly preferably from 8.5 to 9.5°;

the radial angle "B" generally varies from 8 to 22°, preferably between 9 and 20°, and particularly preferably from 10 to 19°.

LIST OF REFERENCE SYMBOLS

Figure 1:
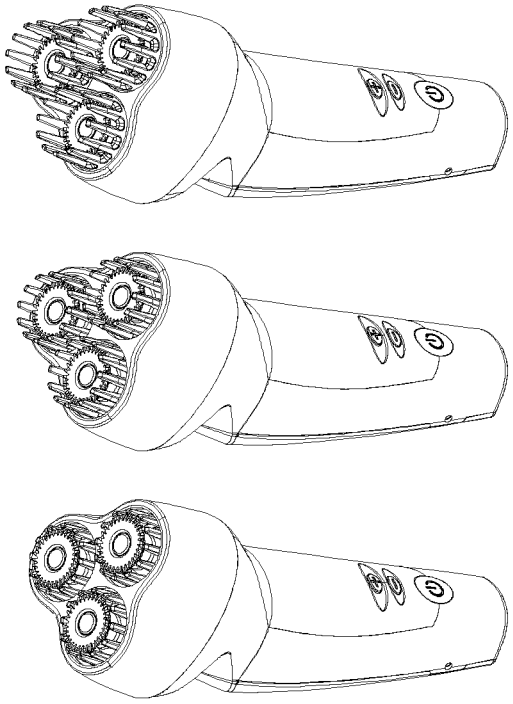
FIG. 1 shows a beard trimmer according to the invention comprising three vertical axis rotary heads. The crown-shaped comb around the rotary heads is shown with three different adjustment heights. These three adjustments for example make it possible to obtain hair lengths of 2, 6 and 10 mm.
Figure 2:
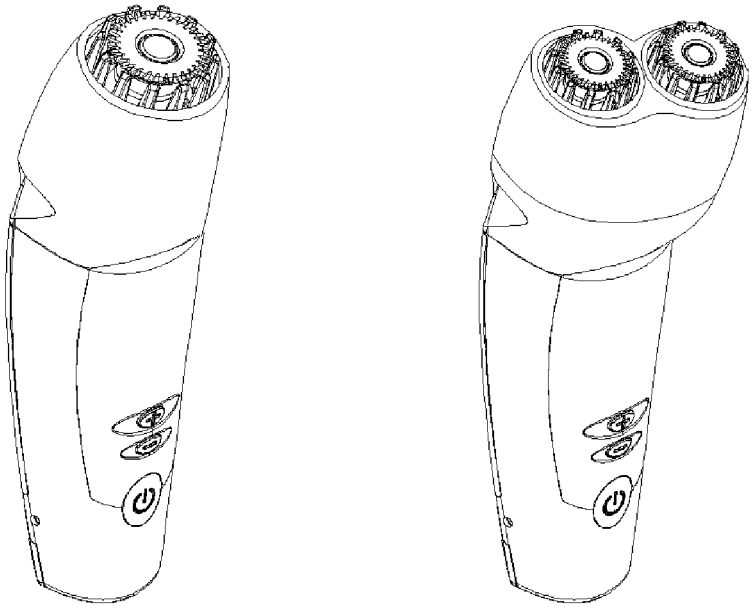
FIG. 2 shows the trimmer according to the invention with one or two vertical axis cutting heads, respectively.
Figure 3:
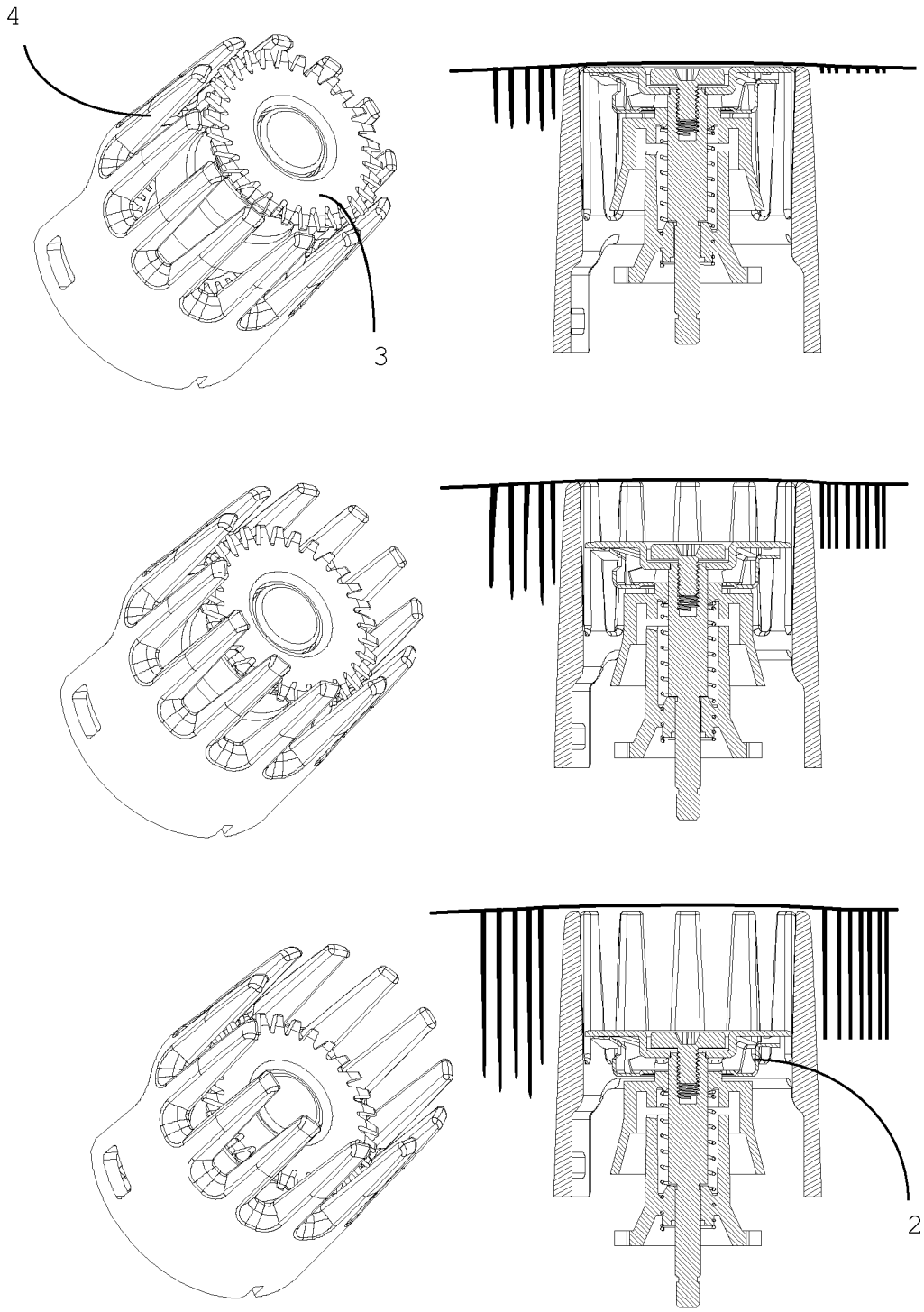
FIG. 3 shows a detailed view of the operating mechanism of the trimmer according to the invention with various beard cutting lengths.

1. Rotary cutting head with a vertical axis
2. Moving blade
3. Fixed blade
4. Crown-shaped comb surrounding the cutting head
5. Cover
6. Push button causing the cover to start moving toward the protection position for the comb
7. Handle
8. Anchoring of the cover
9. Shaft
11. Spring
12. Outer Surface of Cover

DETAILED DESCRIPTION OF THE INVENTION

Unlike the beard trimmers of the state of the art, the trimmer according to the present invention has one or several vertical axis rotary heads 1, surrounded by crown-shaped combs 4, the height of which can be adjusted to within half a millimeter. This adjustment can be manual or motorized (not shown). This trimmer allows a movement in arcs of circle over the beard, just like a rotary head razor. This type of movement has the advantage of beginning to trim the hairs from all sides, irrespective of the incline thereof relative to the skin, which results in uniform trimming of the beard.

The movement of the combs 4 raises the hairs, which ultimately penetrate from the outside toward the inside via the space left between the teeth toward the trimming zone. The particular shape of the teeth of the comb 4, which become gradually finer toward the tip, allows easy penetration of the beard hairs toward the trimming element made up of a fixed blade 3 and a moving blade 2.

The fixed blade 3 comprises radial notches, which also favors the penetration of the hairs in the cutting mechanism.

Figure 4:
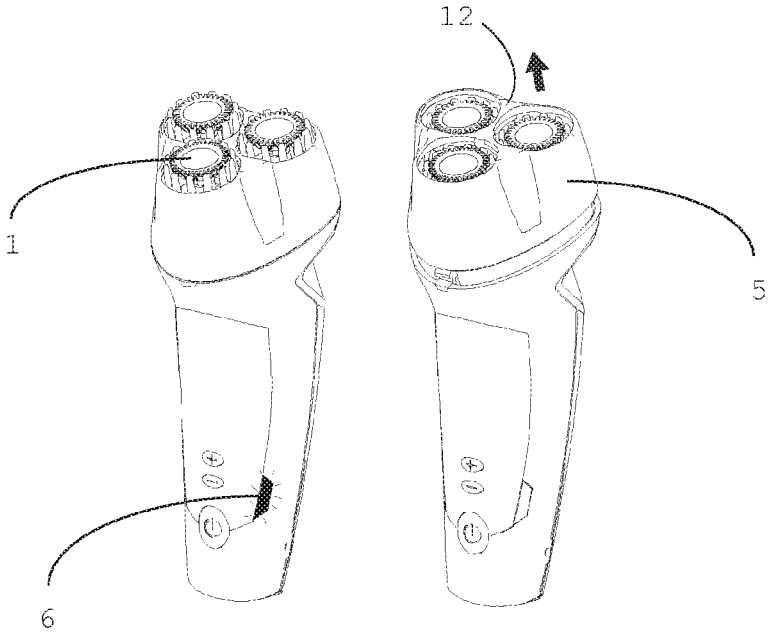
FIG. 4 shows the trimmer in its protection position for the combs with the cover brought approximately flush with the end of the teeth of the combs. The movement of the cover creates a slit between the handle and the cover.
Figure 5:
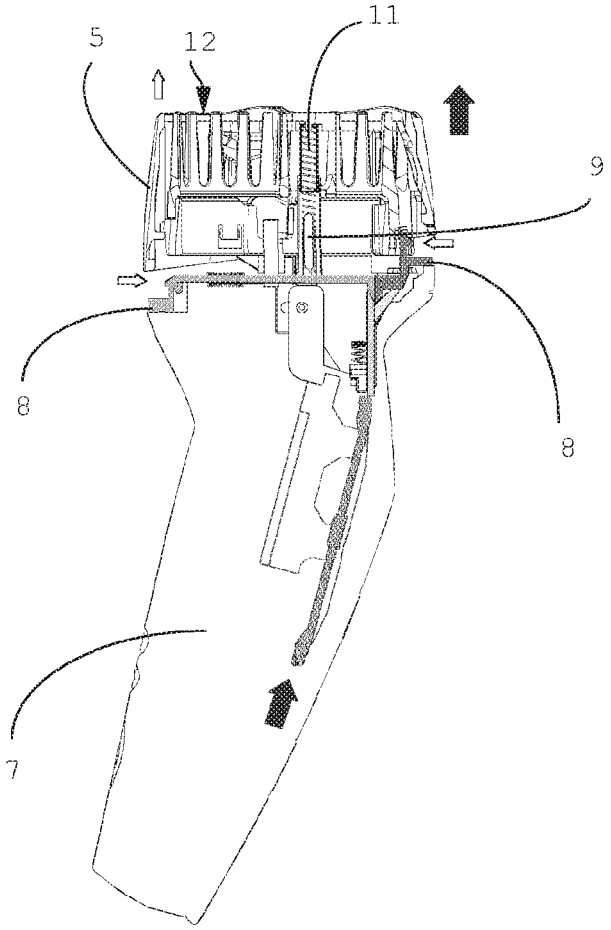
FIG. 5 shows a sectional view of the trimmer according to the invention with the mobility mechanism making it possible to reach the position of the cover protecting the combs.

The height of the telescoping combs 4 can be adjusted approximately between 0 and 15 mm, preferably between 0 and 12 mm, and particularly preferably between 0 and 10 mm. Given the length of the combs, they are not completely retractable in the cover 5 to potentially occupy less space when storing the trimmer. The trimmer therefore requires a protection mechanism for the teeth of the combs. This position is shown in FIG. 4. It is reached by releasing the cover from its anchoring 8 by an appropriate means (push button 6, for example). Once the cover has been released, it moves away from the handle 7 and is translated toward the tip of the teeth of the combs so as to bring an outer surface 12 of the cover 5 approximately flush with the teeth of the combs.

To improve the penetration of the beard hairs through the teeth of the combs, the latter have a particular shape and spacing.

Figure 6:
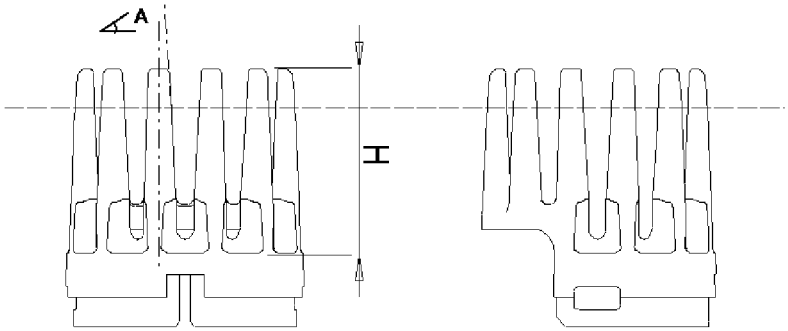
FIG. 6 shows the important parameters defining the geometry and spacing of the teeth of the combs around the cutting heads.
Figure 6:
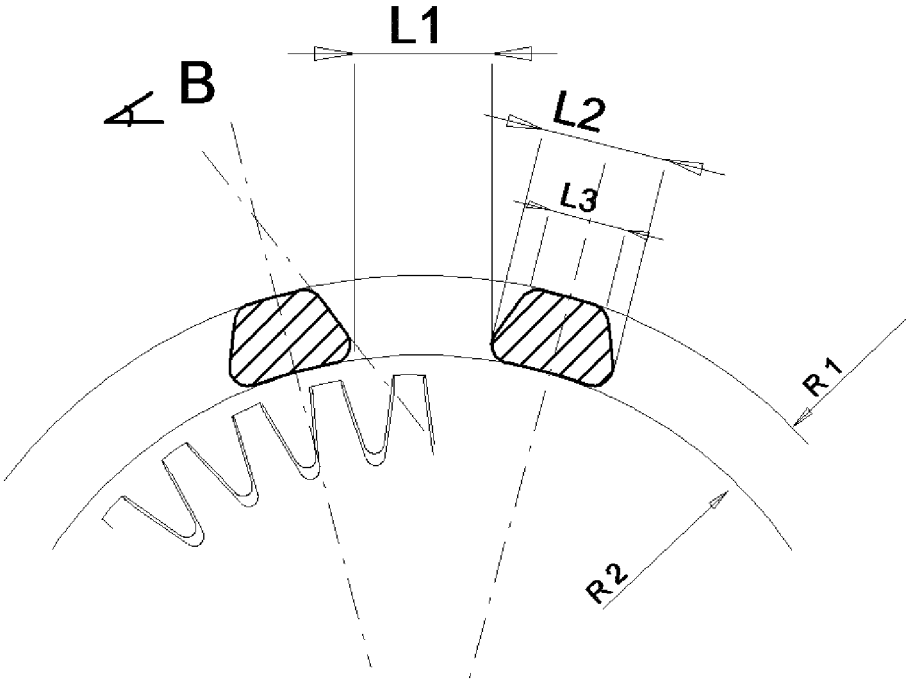

The important parameters of the geometry and arrangement of the teeth of the combs are shown in FIG. 6.

"A" represents the axial angle of the comb, while "B" represents the radial angle;

L1 represents the distance between the teeth, L2 represents the large width of the tooth at the base, and L3 the small width of the tooth at the base;

R1 and R2 respectively represent the outer radius and the inner radius of the crown of teeth;

H represents the height of the tooth.

There is a relationship between these parameters, and a smaller thickness of the teeth must be compensated by a greater width to ensure sufficient rigidity, which reduces the space between the teeth and may prove unfavorable for the penetration of the hairs through the teeth toward the cutting system.

Figure 7:
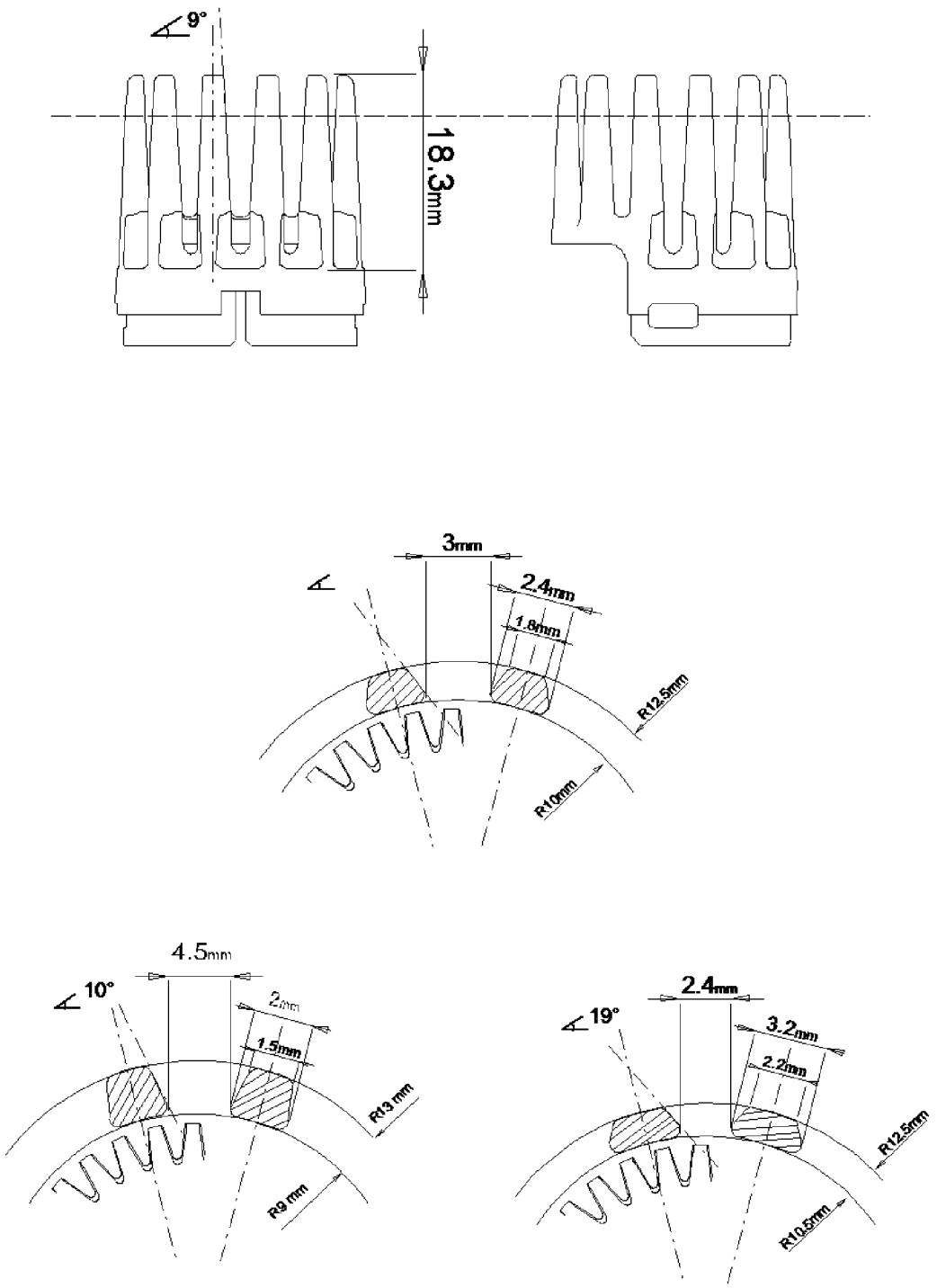
FIG. 7 shows three dimensioning examples of the combs.
Figure 8:
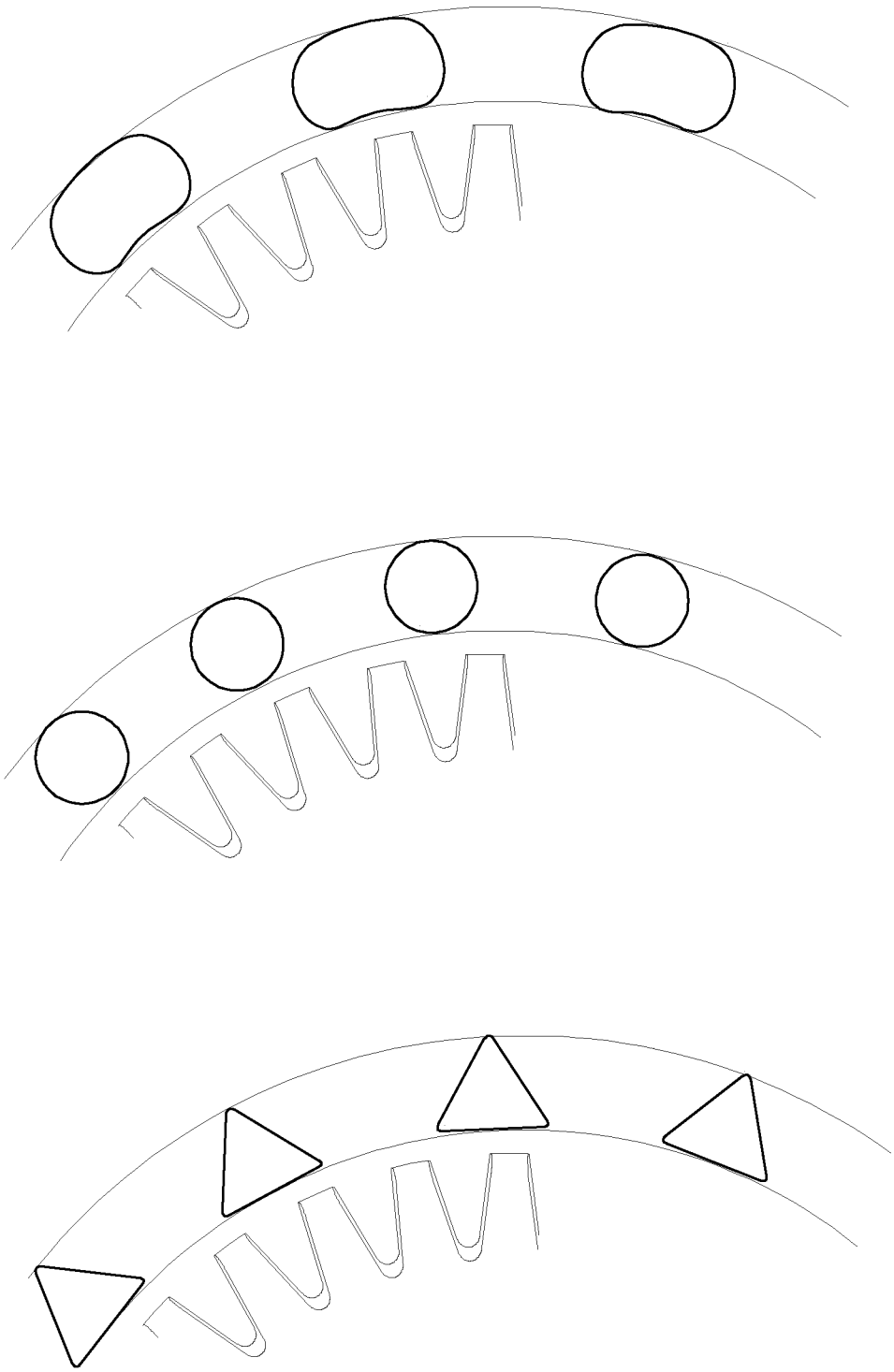
FIG. 8 shows different possible shapes for the base of the teeth of the combs of the trimmer according to the invention.

FIG. 7 shows three dimensioning examples of the combs. The examples are only intended to illustrate the invention, without limiting it. In these examples, one can see that the thickness of the teeth (R1–R2) varies from 2 to 4 mm. The space between the teeth varies from 2.4 to 4.5 mm. The angle "A" is 9°, and the angle "B" varies from 10 to 19°.

Experiments have shown that the ratio between the spacing of the teeth L1 and their thickness: L1/R1-R2 should be situated between 1 and 2, preferably between 1 and 1.8, and particularly preferably between 1.1 and 1.6 to ensure adequate penetration of the hairs in the fixed blade of the cutting system.

The angles "A" and "B" also play an important role, since they determine the penetration angle of the beard hairs toward the fixed blade. The variation of these angles must of course be compatible with the other dimensions of the tooth. The larger "A" is, the pointier the teeth are, and in principle more fragile if L2 and L3 are not too large. The axial angle "A" preferably varies between 7 and 11°, preferably between 8 and 10°, and particularly preferably from 8.5 to 9.5°. The angle "B" generally varies from 8 to 22°, preferably between 9 and 20°, and particularly preferably from 10 to 19°. The angle is of course smaller for high thicknesses (R1-R2) than for low thicknesses.

Furthermore, for rigidity and mechanical strength reasons, the ratio between the height H of the teeth and their section surface area at the base of the comb (that is to say H/Section) should be situated between 2 and 4, preferably between 2.3 and 3.5, and particularly preferably between 2.5 and 3 $mm^{-1}$. The section of the base of the tooth is calculated by the formula (R1–R2)·(L2–L3/2), multiplying the thickness of the tooth by the average of its base.

The section of the base of the tooth can also be measured if it does not correspond to a precise geometric shape.

The present disclosure may include one or more of the following concepts:

A. A beard trimmer comprising a handle (7) and a cover (5), as well as a cutting system with one or several vertical axis rotary cutting heads (1), said rotary cutting heads comprising a moving blade (2) and a fixed blade (3), each head being surrounded by a crown-shaped comb (4), said comb (4) being height adjustable and allowing to adjust, in use, the distance between said blades (2, 3) and the skin, and thereby to adapt the cutting of the beard hairs to the desired length, characterized in that said cover (5) is movably mounted between a closed position and an open position on said handle (7) such that the cover (5) can be moved from an open position into a protection position where it is flush with the teeth of the comb in order to store the device.

B. The beard trimmer in accordance with paragraph A, characterized in that the protection position for the combs is reached by actuating a means, such as push button (6), for moving the cover (5) away from the handle (7).

C. The beard trimmer in accordance with any of the previous paragraphs, characterized in that the cover (5) is translated along the direction of a shaft (9) to reach the protection position for the combs.

D. The beard trimmer in accordance with any of the previous paragraphs, characterized in that the means for moving the cover (5) away releases the latter from its anchoring (8) so as to cause the translational movement by a spring located around the shaft (9) to reach the protection position for the combs.

E. The beard trimmer in accordance with any of the previous paragraphs, characterized in that the movement of the cover (5) away from the handle (7) is motorized.

F. The beard trimmer in accordance with any of the previous paragraphs, characterized in that said trimmer comprises two or three rotary heads.

G. The beard trimmer in accordance with any of the previous paragraphs, characterized in that the ratio between the spacing of the teeth L1 of the comb (4) and their thickness R1–R2, that is to say the ratio L1/R1–R2, is situated between 1 and 2, preferably between 1 and 1.8, and particularly preferably between 1.1 and 1.6 to ensure adequate penetration of the hairs in the fixed blade of the cutting system.

H. The beard trimmer in accordance with any of the previous paragraphs, characterized in that the ratio between the height H of the teeth and the surface area of their section at the base of the comb is situated between 2 and 4, preferably between 2.3 and 3.5, and particularly preferably between 2.5 and 3 $mm^{-1}$.

I. The beard trimmer in accordance with any of the previous paragraphs, characterized in that the axial angle "A" varies between 7 and 11°, preferably between 8 and 10°, and particularly preferably from 8.5 to 9.5°.

J. The beard trimmer in accordance with any of the previous paragraphs, characterized in that the radial angle "B" generally varies from 8 to 22°, preferably between 9 and 20°, and particularly preferably from 10 to 19°.

The invention claimed is:

1. A beard trimmer comprising:

an elongate handle;

a cutting system coupled to a first end of the handle and having one or more rotary cutting heads, each of the one or more rotary cutting heads being surrounded by crown-shaped toothed comb; and a cover coupled to the first end of the handle, such that the one or more rotary cutting heads and combs extend through one or more corresponding openings in an outer surface of the cover;

wherein the cover is configured to translate relative to the teeth of the one or more combs between a closed position, in which the cover is adjacent the handle, and a protection position, in which a space is provided between the cover and the handle and the outer surface of the cover is flush with the teeth of the one or more combs.

2. The beard trimmer according to claim 1, wherein the one or more rotary cutting heads of said trimmer comprise two or three rotary cutting heads, and the one or more corresponding openings in the outer surface of the cover comprise two or three corresponding openings.

3. The beard trimmer according to claim 1, wherein a ratio between a spacing of the teeth on the one or more combs and a thickness of each of the teeth, is between 1 and 2.

4. The beard trimmer according to claim 1, wherein a ratio between a height of one of the teeth on the one or more combs and a surface area of a section of a base of the one of the teeth is between 2 and 4 $mm^{-1}$.

5. The beard trimmer of claim 1, wherein the cover is biased toward the protection position by a spring.

6. The beard trimmer of claim 1, wherein each of the one or more rotary cutting heads comprises a moving blade and a fixed blade.

* * * * *